US008899452B2

(12) United States Patent
Takanohashi

(10) Patent No.: US 8,899,452 B2
(45) Date of Patent: Dec. 2, 2014

(54) PLUG STRUCTURE

(75) Inventor: Toshiyuki Takanohashi, Saitama (JP)

(73) Assignee: Surpass Industry Co., Ltd., Saitama (JP)

( * ) Notice: Subject to any disclaimer, the term of this patent is extended or adjusted under 35 U.S.C. 154(b) by 233 days.

(21) Appl. No.: 12/359,685

(22) Filed: Jan. 26, 2009

(65) Prior Publication Data

US 2009/0188919 A1 Jul. 30, 2009

(30) Foreign Application Priority Data

Jan. 28, 2008 (JP) ..... 2008-016234

(51) Int. Cl.
*B65D 83/00* (2006.01)
*B65D 51/16* (2006.01)
*B67D 7/02* (2010.01)

(52) U.S. Cl.
CPC ..... *B65D 51/1683* (2013.01); *B67D 7/0288* (2013.01)
USPC ..... 222/400.7; 222/318; 222/424; 137/212; 137/563

(58) Field of Classification Search
CPC ..... B65D 51/1683; B67D 7/0288
USPC ..... 222/318, 400.7, 424, 464.1; 137/212, 137/563
See application file for complete search history.

(56) References Cited

U.S. PATENT DOCUMENTS 2,150,673 A * 3/1939 De Steffan ..... 62/399
5,148,208 A * 9/1992 Klosterboer et al. ..... 396/571
6,079,597 A * 6/2000 Rauworth et al. ..... 222/400.7
6,955,185 B2 * 10/2005 Rauworth et al. ..... 137/588
2003/0010387 A1 * 1/2003 Rauworth et al. ..... 137/588
2006/0243755 A1 * 11/2006 Hennen et al. ..... 222/464.1

FOREIGN PATENT DOCUMENTS

JP H05-14000 2/1993
JP 2559003 Y2 9/1997
JP 2002-059993 2/2002
JP 2003-237734 A 8/2003
JP 2005508730 4/2005
WO WO03006359 A2 1/2003

OTHER PUBLICATIONS

Japanese Office Action mailed Feb. 21, 2012, for corresponding Japanese Application No. 2008-016234.
Japan Patent Office, Notice of Reasons for Rejection for Application No. 2008-016234, mailed Dec. 4, 2012, 4 pages, Japan.

* cited by examiner

*Primary Examiner* — Daniel R Shearer
(74) *Attorney, Agent, or Firm* — Alston & Bird LLP

(57) ABSTRACT

A plug structure is provided that can be installed on a container in which the thread of a container inlet for installing a cap is an outer thread, and furthermore, bubbles are not produced at the fluid surface inside the container even during fluid circulation. In a plug structure that is used in a container in which the thread of the container inlet for attaching the cap is an external thread, that is installed on the container inlet, that is capable of removing a fluid inside the container by using the siphon hose method, and that is capable of circulating the fluid that is inside the container, a fluid circulation path is provided that causes a fluid that is returning into the container during fluid circulation to fall along an external wall of a siphon hose during fluid removal.

2 Claims, 8 Drawing Sheets

PLUG STRUCTURE

CROSS REFERENCE TO RELATED APPLICATIONS

This application claims priority to Japanese Patent Application No. 2008 016234, filed on Jan. 28, 2008, the contents of which are incorporated herein by reference.

FIELD OF THE INVENTION

The present invention relates to a plug structure that is attached to an opening of a container in which fluids such as high-purity chemical products for semiconductors and general-use chemical products and the like are stored, and in particular, relates to a plug structure that can circulate the fluid that is in the container.

BACKGROUND OF THE INVENTION

Generally, fluids such as high-purity chemical products for semiconductors and general-use chemical products and the like are filled into containers such as glass bottles and polyethylene tanks at a production facility, and they are then shipped with a lid attached to the opening for filling and discharging that is formed in this fluid tank. One known method for removing the fluid that has been stored in such a fluid tank is the siphon hose method, in which the fluid is fed to the outside of the container by gas pressure that is produced by introducing a gas, such as air, into the container.

In this method, after removing the lid that has been attached to the opening (below, referred to as a "container inlet") for filling and discharge from the fluid tank, a plug is installed in the container inlet and then a socket is engaged in the plug. The plug is provided with a siphon hose, which forms a fluid path, and a gas supply duct. A tube for removing fluid and a tube for introducing gas can be connected with the socket. The socket enables respective communication of the tube for removing fluid and the tube for introducing gas with the siphon hose and the gas supply duct of the plug. By engaging the socket in the plug, a primary path for removing fluid and a secondary path for introducing gas are formed in the plug and the socket that are attached to the opening of the container inlet. (Such a fluid tank connector is disclosed, for example, in Japanese Unexamined Patent Application, First Publication No. 2002-59993.)

However, the conventional technology that is disclosed in the above document is a connecting fixture that includes a plug, which is attached to the opening of the container in which a fluid is stored, and a socket, which is connected to this plug. The plug in this case is one that is attached by being threaded into an internal thread that is formed in the opening of the container inlet, and thus, this plug cannot be used in a container in which an external thread is formed on the opening of the container inlet, that is, a container in which the thread for attaching the cap that closes the opening of the container inlet is an external thread.

Note that in this conventional technology, because gas holes are provided in the side surface of a center plug, another problem that has been pointed out is that fluid pooling occurs easily.

In addition, in a plug in which the fluid in a container is removed by using the siphon hose method described above, there are cases in which the fluid that is in the container is circulated by using the siphon hose. In these cases, in addition to the gas path that is used for introducing a gas, the socket, which is used by being coupled to the plug, is provided with a fluid removal path through which the fluid in the container is removed and a fluid return path through which the fluid that has been removed is returned to the container. According to such a plug structure, during fluid circulation, because the fluid removal path and the fluid return path are linked at the outside of the socket, the fluid that has been removed through the siphon hose due to the introduction of gas returns into the container by passing from the fluid removal path through the fluid return path.

During such fluid circulation, when the fluid that is returned into the container from the fluid return path freely falls onto the fluid surface, bubbles are produced due to gas that is incorporated from the fluid surface into the fluid. However, this is not preferable in terms of accurate flow rate measurement and quality control and the like because such bubbles indicate that gas has become trapped in the fluid, such as a chemical product.

In view of the above circumstances, in a plug structure that is used in a container that is filled with a fluid such as a chemical product and the like and is provided with a siphon hose for delivering the fluid to the outside of the container by using the pressure of a gas, the development of a plug structure is desired that can be attached to a container in which the thread of the container inlet for attaching a cap is an external thread, and furthermore, that does not produce bubbles on the fluid surface inside the container even during fluid circulation when the fluid such as a chemical product is being circulated.

BRIEF SUMMARY OF THE INVENTION

In consideration of the circumstances described above, it is an object of the present invention to provide a plug structure that can be attached to a container in which the thread for the attachment of the cap on the container inlet is an external thread, and that does not produce bubbles on the fluid surface inside the container during fluid circulation.

The present invention employs the following solutions in order to solve the problems described above.

The plug structure according to the present invention, which can be used in a container in which the thread of the container inlet for attaching a cap is an external thread and, after being attached to the container inlet, enables both the removal of fluid inside the container by using the siphon hose method and the circulation of the fluid in the container, is characterized in that a fluid circulation path is provided in which the fluid that has returned into the container during fluid circulation falls along the outer wall of the siphon hose for fluid removal.

According to such a plug structure, because a fluid circulation path is provided in which the fluid that returns into the container during fluid circulation falls along the outer wall of the siphon hose for fluid removal, it is possible to prevent the fluid from freely falling due to gravity through the space inside the container.

In the invention described above, preferably, the fluid circulating path serves as a gas supply duct that is disposed on the periphery of the outer wall of the siphon hose and supplies gas to the inside of the container, and the inner peripheral side of the wall surface of the gas supply duct is formed by the outer wall of the siphon hose. Thus, the fluid circulation path also serves as a gas path, and it is possible to cause the fluid that returns into the container to fall smoothly along the outer wall of the siphon hose. Note that it is desirable that the fluid circulation path in this case secures a sufficient opening area by using, for example, long holes and increasing the number of circular openings so that pressure is not applied by the fluid that is returning into the container.

In addition, when the gas supply duct is used as the fluid circulation path, preferably the inlet of the gas supply duct has a sloped wall that slopes downward from the outer periphery toward the inner periphery, and it is thereby possible to prevent pooling from occurring in the gas supply duct, which serves as the fluid circulation path.

In the invention described above, preferably a fluid guide portion is provided on the outer wall of the siphon hose, and it is thereby possible to reliably guide the fluid that is returning into the container along the outer wall of the siphon hose to the fluid surface. As a fluid guide portion for this case, a spiral convex portion that is formed on the outer wall or a substantially vertical (the axial direction of the siphon hose) groove that is formed on the outer wall portion is advantageous.

In the invention described above, preferably a fluid retaining portion is provided that projects from the outer wall of the siphon hose at a location thereon, and the inner wall of each fluid outlet, which open after passes through the fluid retaining portion, is formed by a surface of the outer wall of the siphon hose. It is thereby possible to restrain the falling speed because the fluid is temporarily retained in the fluid retaining portion while falling along the siphon hose. Note that the fluid that is retained in the fluid retaining portion flows downward along this outer wall of the siphon hose from the fluid outlets, whose inner wall surface is formed by the outer wall of the siphon hose, and thus, the fluid does not fall freely below the fluid retaining portion.

Effects of the Invention

According to the invention described above, a plug structure, which is used in a container that is filled with a fluid such as a chemical product and which is provided with a siphon hose for removing the fluid to the outside of the container, can be installed in a container in which the thread of the container inlet for installing the cap is an external thread. Furthermore, the plug structure is one in which, during fluid circulation, when a fluid such as a chemical product is circulated, because it is possible to cause the fluid to fall to the fluid surface along the outer wall of the siphon hose, bubbles are not produced on the fluid surface inside the container.

DETAILED DESCRIPTION OF THE INVENTION

Below, an embodiment of the plug structure according to the present invention will be explained with reference to FIG. 1 and FIG. 2.

Figure 1:
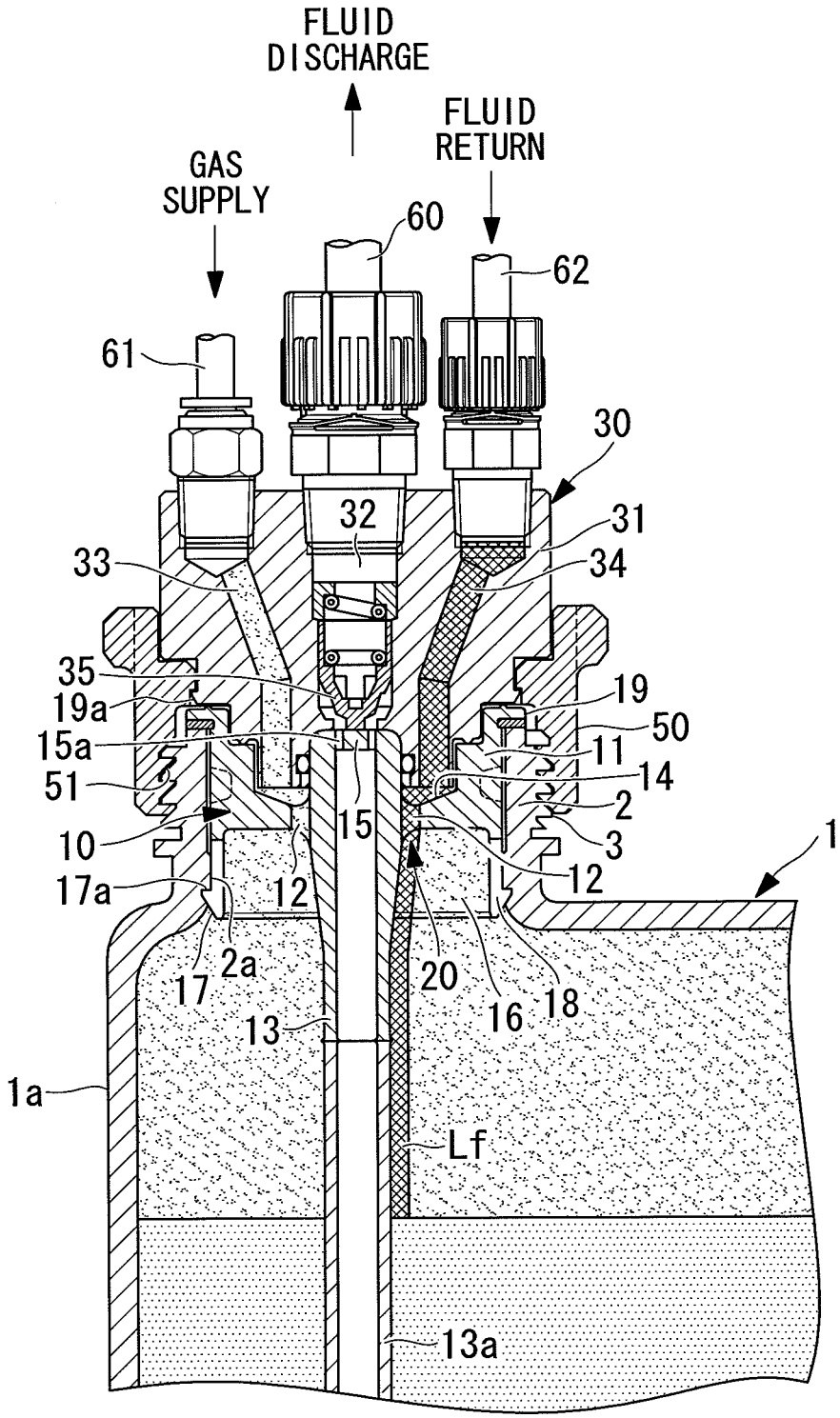
FIG. 1 is a drawing that shows an embodiment of the plug structure of one embodiment of the present invention, and is a cross-sectional view that shows the state in which the socket for fluid circulation is installed in the container.
Figure 2:
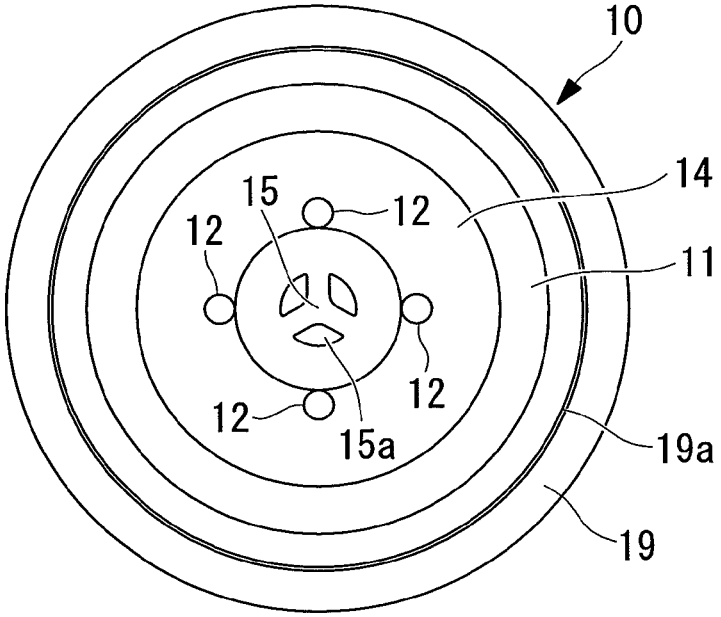
FIG. 2 is a plan view that shows the state in which the socket has been removed from the plug structure of FIG. 1.

In FIG. 1 and FIG. 2, reference numeral 1 denotes a container, reference numeral 10 denotes a plug, and reference numeral 30 denotes a socket. In order to remove a fluid that is stored in the inside of the container 1, the plug 10 of the present invention uses a siphon hose method in which a gas, such as air, is introduced to the inside of the container 1, and the fluid is fed to the outside of the container 1 due to the gas pressure generated thereby. In addition, in the case in which the socket 30 is provided with a fluid return path 34, which will be described below, this plug 10 is used to circulate the fluid that is inside the container 1 in addition to being used to remove the fluid that is inside the container 1.

The container 1 that is filled with a chemical fluid (fluid), such as a high-purity chemical product for semiconductors, is a molded product made, for example, of a chemically resistant resin or the like. A container inlet 2, which is used for filling and removing the fluid, is provided on the upper portion of the container 1. This container inlet 2 is an opening that is used not only to fill a fluid such as a chemical fluid into the inside of the container 1, but is also used when the chemical fluid inside of the container 1 is removed or circulated.

The fluid port 2 is a cylindrical nozzle that projects upward from the body 1*a* of the fluid tank 1 and whose upper end is open, and as shown, for example, in FIG. 1, is provided with an external thread 3 that is used for installing a sealing cap and the like. Note that the cap in this case (not illustrated) is a type in which an internal thread is formed on the inner peripheral surface thereof, and the cap is installed by being threaded onto the external thread 3 that is formed on the outer peripheral surface of the container inlet 2.

The plug 10 is a molded part made of resin and the like, and is press fit from above into the open portion of the container inlet 2 to be installed therein. This plug 10 is provided with gas supply ducts 12 and a siphon hose 13 that are formed in the substantially cylindrical plug body 11.

The gas supply ducts 12 are paths for supplying a gas that is introduced from the outside to the inside of the fluid tank 1. These gas supply ducts 12 are holes that pass through the bottom surface 14 of the plug body 11 in an axial direction, and are provided in plurality so as to surround the outer periphery of the siphon hose 13 that is disposed at the axial center of the plug body 11. In the example structure that is shown in FIG. 2, gas supply ducts 12 are in contact with and partially formed by the outer wall of the siphon hose 13, and these gas supply ducts 12 are provided at four locations at a 90° pitch so as to surround the outer periphery of the siphon hose 13.

Preferably, the upper surface of the inlet portion of each gas supply duct 12 described above has a bowl shape that is provided with a slope that slopes downward toward the opening of each of the gas supply ducts 12. That is, the vicinity of the upper surface inlet portion of each gas supply duct 12, which opens in the bottom surface 14, is provided, for example, with a sloped surface that slopes downward from the outer periphery toward the siphon hose 13 on the inner periphery by beveling the angled portion of the opening of each gas supply duct 12. In addition, the sloped surface is shaped such that any fluid that enters onto the bottom surface 14 is readily guided to the low opening position of the gas supply ducts 12 without pooling therein.

The upper surface inlet portion of such a gas supply duct 12 is effective in the case in which, for example, a slurry-like chemical product that readily solidifies is handled. An example of such a slurry-like chemical product is silicon dioxide dispersed in a water medium, which is used in a wafer polishing process of a semiconductor fabrication process.

Specifically, in the case in which, for example, a fluid that readily solidifies due to changes in the fluid surface inside the container passes up and out of the gas supply ducts 12 during shipping and the like and enters onto the bottom surface 14, if the upper inlet portion of the gas supply ducts 12 has a bowl shape, the fluid is discharged quickly without pooling on the bottom surface 14, and it is thereby possible to prevent the fluid from solidifying and adhering to the bottom surface 14. Note that the solidifying and adhering of a chemical fluid causes deterioration and the like, and thus is not preferable.

The siphon hose 13 is a path through which the fluid inside the fluid tank 1 is removed by being pushed out by the pressure of a gas, and extends from the plug body 11 to the proximity of the bottom surface of the fluid tank 1. As shown, for example, in FIG. 1, the length that is necessary for the illustrated siphon hose 13 is ensured by coupling an extension tube 13*a* to a portion that is integrally formed with the plug body 11. Note that in the following explanation, except when the distinction is necessary, the entire tube, including the extension tube 13*a*, is referred to as the siphon hose 13.

In addition, at the upper end entrance portion of the siphon hose 13, a valve-actuating portion is provided that pushes up and opens a fluid outflow valve 35 that is provided in the socket 30, which will be described below. This valve-actuating portion 15 only partially closes off (in particular, the axially central position) the upper end inlet portion by maintaining feed-through portions 15*a*, which serve as fluid paths for the siphon hose 13 so that the lower end portion of the valve 35 abuts and is thereby pressed upward by the valve-actuating portion 15. Note that depending on the type of the socket 30 that is used in combination with the plug 10, there are cases in which this valve-actuating portion 15 is unnecessary.

The plug 10 described above is one in which lower portion 16 of the plug body 11, which is press fit into the container inlet 2, is elastically deformable in a radial direction, and an engagement catch 17 that projects toward the inner wall surface 2*a* of the container inlet 2 is provided on the outer peripheral surface of the lower portion of the plug body 11. The lower portion 16 of the plug body 11 has a thin-walled ring shape and is readily elastically deformed in a radial direction by providing radial slits 18 at appropriate locations (for example, at four locations at a 90° pitch). Note that, in the following explanation, a case is explained in which an elastically deformable lower portion 16 and an engaging catch 17 are provided on the plug body 11, but the plug body 11 may have a shape that is simply inserted, without having the elastically deformable lower portion 16 or engaging catch 17.

In addition, the engaging catch 17 described above is made such that the minimum diameter of the lower end portion thereof is set so as to be substantially equal to or slightly smaller than the inner diameter of the container inlet 2, and the maximum diameter of the upper end portion is set so as to take a value that is appropriately larger than the inner diameter of the container inlet 2. Note that the upper end portion of the engaging catch 17 is provided with a stepped portion 17*a* that is less than this maximum diameter.

Specifically, the lower portion 16 of the plug body 11 is provided with an engaging catch 17 that has a thin-walled cylindrical skirt shape partitioned in the peripheral direction by the slits 18, and that projects outward on the outer peripheral surface of the lower portion on the lower end portion side.

Because the plug 10 has such a structure, the plug body 11 that has been press fit into the container inlet 2 passes through to a predetermined location due to the bottom portion 16, on which the engaging 17 is provided, elastically deforming radially inward (the direction toward the axis center) by an amount equivalent to the projection. Specifically, when the lower end portion of the plug body 11 passes through to a predetermined position by the maximum diameter portion of the engagement catch 17 having decreased due to elastic deformation so as to equal the inner diameter of the container inlet 2, the lower portion 16 of the elastically deformed plug body 11 is pressed against the inner wall surface 2*a* of the container inlet 2 due to the force that acts in a direction that tends to restore the engaging catch 17 to its original shape. At this time, if the inner diameter of the container inlet 2 expands even a little at the position of the engagement catch 17 that has been reached due to press fitting, the stepped portion 17*a* of the engaging catch 17 engages the inner wall surface 2*a*, and thereby serves as a more reliable retainer.

Therefore, the plug 10 that has been press fit into the container inlet 2 is fastened inside the container inlet 2 due to the elasticity of the lower portion 16 that has been provided with the engaging catch 17.

In addition, the plug 10 described above is provided with an upper end flange-shaped collar portion 19 that is formed so as to extend in an outward direction from the upper end portion of the plug body 11 and that is engaged by the upper end surface of the container inlet 2. In addition, on the lower surface at which the collar portion 19 is in close contact with the upper end surface of the container inlet 2, a ring-shaped convex portion (not illustrated) is formed over the entire periphery thereof. This convex portion functions as a sealing portion that prevents the discharge of gas between the container 1 and the plug 10 during the removal of a fluid, and at the same time, functions as a sealing portion that prevents the discharge of gas or fluid between the container 1 and the plug 10 during the transport of the container 1 or in the event that the container 1 is overturned.

Furthermore, preferably, the upper surface of the collar portion 19 described above also has a ring-shaped convex portion 19*a* formed over the entire periphery. When the cap is installed after the plug 10 has been press fit, this convex portion 19*a* functions as a sealing portion that prevents the discharge of fluid that has passed through and out of the gas supply duct 12 due to agitation of the fluid surface during the transport of the container 1 or in the event that the container 1 is overturned.

As shown, for example, in FIG. 1, when the fluid in the container 1 is removed, the plug 10 having the structure described above is coupled with the socket 30 after the cap has been removed.

The socket 30 is provided with socket body 31 and a sleeve 50 that fixes this socket body 31 to the container 1 so as to be inserted at a predetermined position in the plug 10. The socket body 31 is provided with a fluid removal path 32, a gas path 33, and a fluid return path 34 in a substantially columnar member.

The sleeve 50 enables rotating the outer peripheral portion of the socket body 31. In addition, an inner thread 51 that threads onto the outer thread 3 of the container inlet 2 is formed on the inner peripheral surface of the sleeve 50. Specifically, when the socket 30 is installed, the socket body 31 is inserted at a predetermined position in the plug 10, and then the sleeve 50 is fastened by being rotated so as to thread the internal thread 51 onto the external thread 3. The socket 30 is thereby fixed in a state of close contact with the plug 10.

The fluid removal path 32 is an axial through hole that is formed at the axially center position of the socket body 31, and the external duct 60, through which fluid is discharged, is connected to the upper end portion thereof. When coupled with the plug 10, this fluid removal path 32 forms an integrated fluid path by communicating with the siphon hose 13 that is inserted into the container 1.

The gas path 33 is a through hole that is formed substantially parallel to the fluid removal path 32 described above, and serves as a path in which one end thereof is connected to a gas supply source (not illustrated) via a gas supply duct 61 and the other end thereof communicates from the bottom surface 14 of the plug 10 to the gas supply ducts 12.

The fluid return path 34 is a through hole that is formed substantially parallel to the fluid removal path 32 and the gas path 33 described above. This fluid return path 34 is a path that is only used when the fluid that is inside the container 1 is circulated, and normally the fluid return path 34 is closed by screwing a sealing plug (not illustrated) or the like therein. Note that the other end of the fluid return path 34, similar to the gas path 33, is a path that communicates from the bottom surface 14 of the plug 10 to the gas supply ducts 12.

In addition, when the fluid return path 34 is used for fluid circulation, as shown in FIG. 1, the fluid return path 34 is connected to an external return duct 62 in place of the sealing plug. This external return duct 62 is connected to the container 1 side of an external duct 60 that closes the downstream side of the duct by using a valve or the like.

In addition, the illustrated socket 30 is a type in which a valve 35 is provided in the fluid return path 32. Because this valve 35 is normally urged downward by a valve spring, in the state before being linked with the plug 10, the valve is in close contact with the valve seat, and the fluid removal path 32 is thereby closed.

However, when the socket 30 described above is installed at a predetermined position in the plug 10, the valve-actuating portion 15 that is provided on the plug 10 side pushes the valve up by overcoming the urging force of the spring, and thus the close contact between the valve and the valve seat is released. By opening the valve 35 in this manner, a fluid path is formed that discharges fluid from the inside to the outside of the container 1 through the siphon hose 13 and the fluid removal path 32.

Thus, in a plug structure that is used in a container 1, in which the thread of the container inlet 2 for installing a cap is an external thread 3, and that is installed in the container inlet 2 to enable the removal of a fluid that is inside the container 1 by using a siphon hose method and enable the circulation of the fluid that is inside the container, the lower portion of the plug body 11 that is press fit into the container inlet 2 is elastically deformable in a radial direction, an engaging catch 17 that projects toward the inner wall surface 2*a* of the container inlet 2 is provided on the outer peripheral surface of the lower portion of the plug body 11, and at the same time, a fluid circulation path 20 is provided that causes the fluid that returns into the container 1 during fluid circulation to fall along the outer wall of the siphon hose 13 for fluid removal.

This fluid circulation path 20 is a fluid path that is 25 formed so as to communicate with the fluid return path 34 of the socket 30 described above, and specifically, one among the plurality of the gas supply ducts 12 is used as a portion of the path. Specifically, with the object of supplying fluid that has been introduced into the container 1 from the outside, one of the holes is provided so as to pass through the bottom surface 14 of the plug body 11 in an axial direction. During fluid circulation, when the fluid that is inside the container 1 is circulated, this one hole serves as a fluid return path 20 for returning fluid, which has been pushed out from the siphon hose 13 due to the gas pressure that has been introduced from the gas path 32, into the container 1 again.

Note that the operation in which the fluid that is inside the container 1 is circulated is effected with the object of preventing a fluid such as a chemical fluid or the like from solidifying inside the container 1.

Therefore, the gas supply ducts 12, which are provided in plurality so as to surround the siphon hose 13 that is disposed at the axial center of the plug body 11, are provided so as to be in contact with and partially formed by the outer wall of the siphon hose 13. Specifically, the inner peripheral side of the wall surface of the gas supply ducts 12 and the outer wall of the siphon hose 13 form a continuous wall surface with each other. In other words, the inner peripheral side of the wall surface of the gas supply ducts 12 is formed by the outside wall of the siphon hose 13.

By forming such a fluid circulation path 20, during fluid circulation, the fluid that is returning into the container 1 does not fall freely due to gravity as in the case in which the gas path 12 is provided at a position separated from the outer wall of the siphon hose 13, as shown by the reference symbol Lf in the figures, the fluid falls smoothly along the outer wall of the siphon hose 13.

Figure 3:
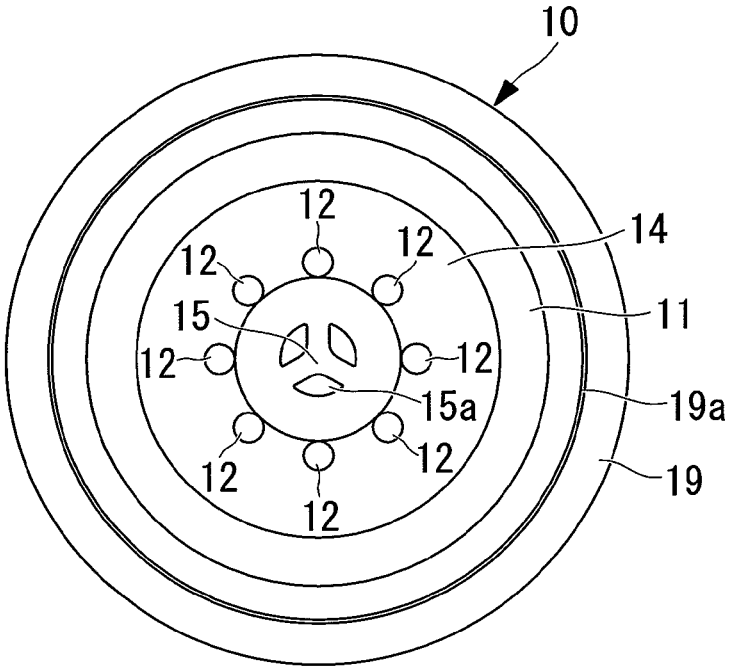
FIG. 3 is a plan view of a first modification of the plug structure that is shown in FIG. 1 and FIG. 2, showing the state in which the socket has been removed.
Figure 4:
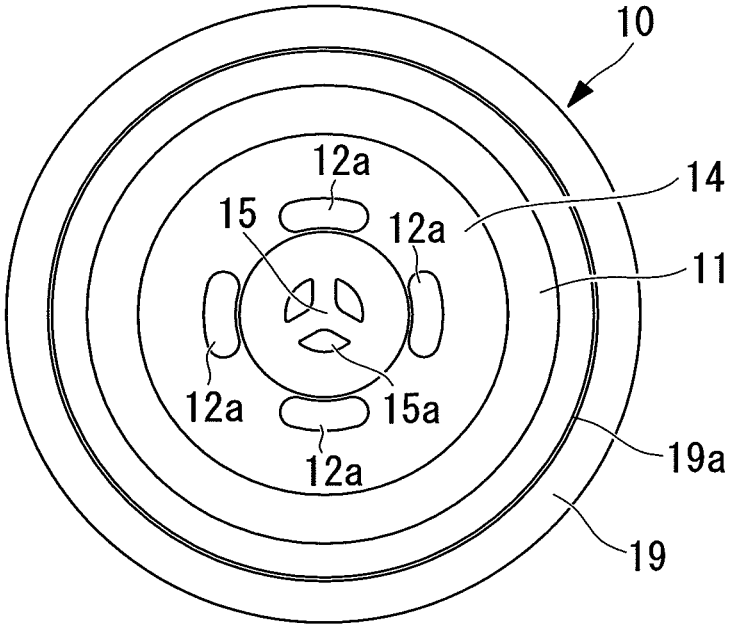
FIG. 4 is a plan view of a second modification of the plug structure that is shown in FIG. 1 and FIG. 2, showing the state in which the socket has been removed.

In this case, for the gas supply duct 12 which serves as a portion of the fluid circulating path 20, in order that the pressure of the fluid that is returning into the container has no effect, preferably the number of round holes that serve as the gas supply ducts 12 is increased, in a manner similar to, for example, the first modified example that is shown in FIG. 3, or alternatively, a sufficient opening area is ensured by using elongated gas supply ducts 12*a* similar to the second modified example 2 that is shown FIG. 4. That is, due to the fluid that is returning into the container 1 pooling at the bottom surface 14, a fluid pressure is generated. Thus, preferably a sufficient opening area is ensured depending on the fluid circulation amount so that the flow rate of the fluid that is returning into the container 1 does not increase due to this pressure.

In addition, in the case in which a gas supply duct 12 is used as a fluid circulating path 20, preferably, the inlet of the gas supply duct 12 includes a sloped surface that slopes downward from the outer periphery toward the inner periphery in order to prevent pooling from occurring in the gas supply duct 12 that serves as the fluid circulation path 20.

Figure 5:
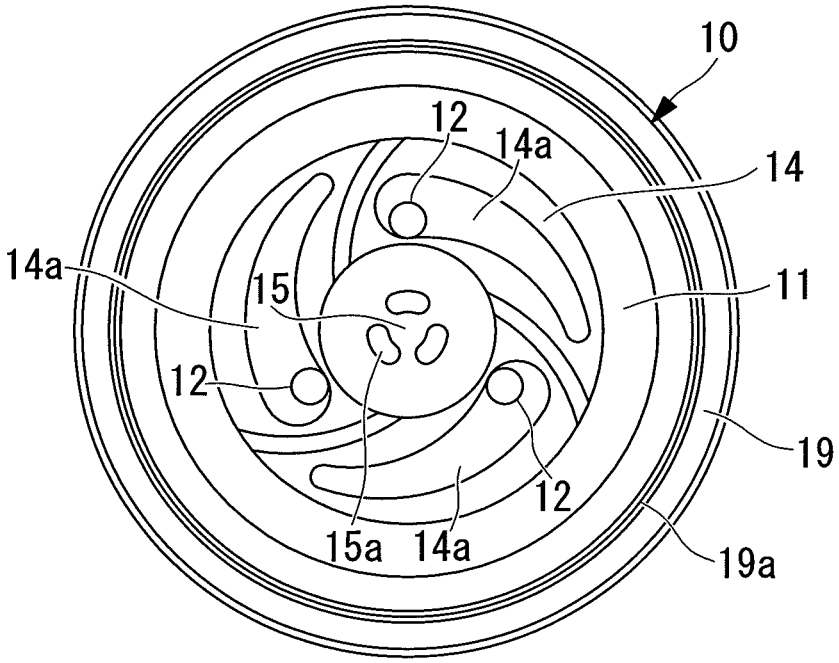
FIG. 5 is a plan view of a third modification of the plug structure that is shown in FIG. 1 and FIG. 2, showing the state in which the socket has been removed.
Figure 6:
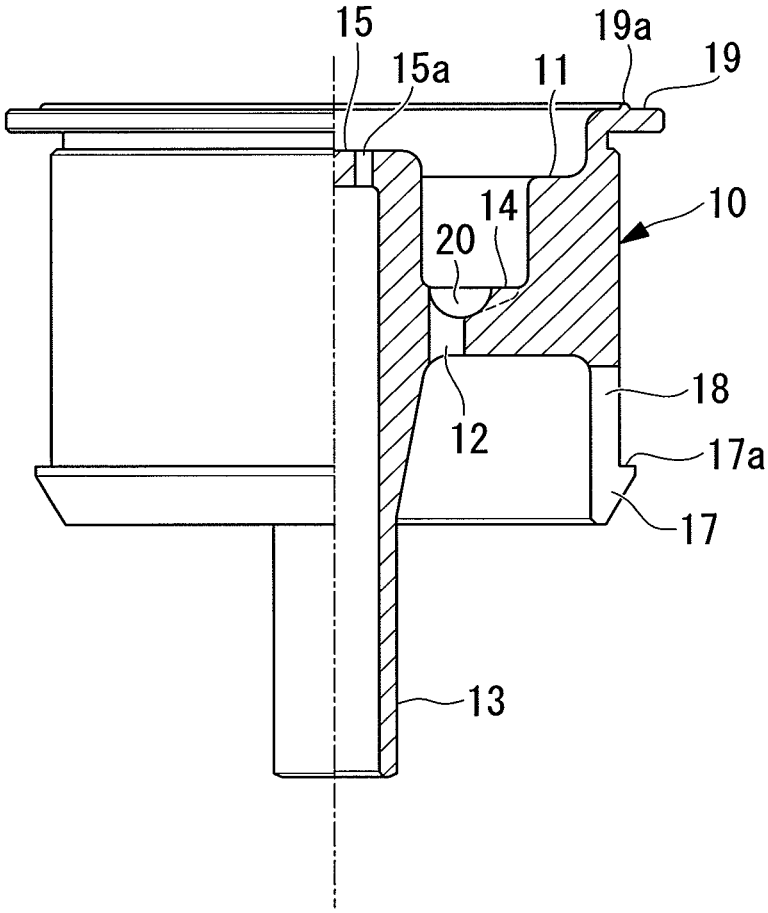
FIG. 6 is a longitudinal cross-sectional view that shows the necessary structures of the third modification that is shown in FIG. 5.

Specifically, similar to the bottom surface 14 that is shown in FIG. 1, a sloping surface may be used in which substantially the entirety thereof slopes from the outer periphery of the bottom surface toward the outer wall surface of the siphon hose 13 that serves as the inner periphery of the bottom surface, or alternatively, similar to the third modified example that is shown in FIG. 5 and FIG. 6, a groove portion 14*a* that includes a sloped surface may be provided on the bottom surface 14, and the gas supply ducts 12 may be bored after disposing the lowest position of the groove portion 14*a* onto the outer wall side of the siphon hose 13.

Figure 7:
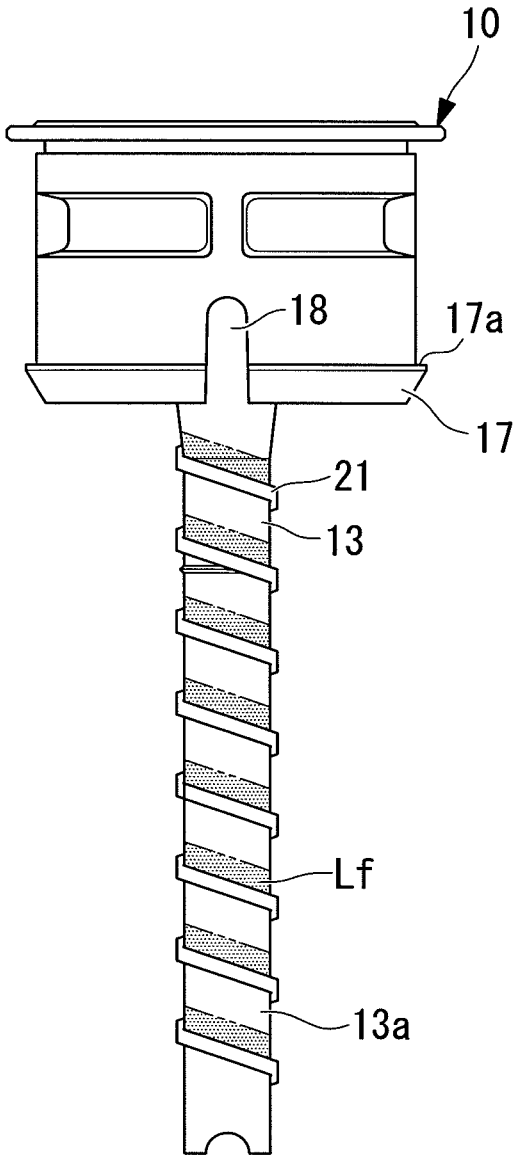
FIG. 7 is a front view that shows a fourth modification of the plug structure according to the present invention.

Next, in the fourth modified example that is shown in FIG. 7, a fluid guide portion 21 is provided on the outer wall of the siphon hose 13. This fluid guide portion 21 provides a spiral convex portion that continues from the gas supply ducts 12 into the fluid. Therefore, the fluid that falls along the outer wall of the siphon hose 13 falls to the fluid surface while spiraling down around the fluid guide portion 21.

Figure 8:
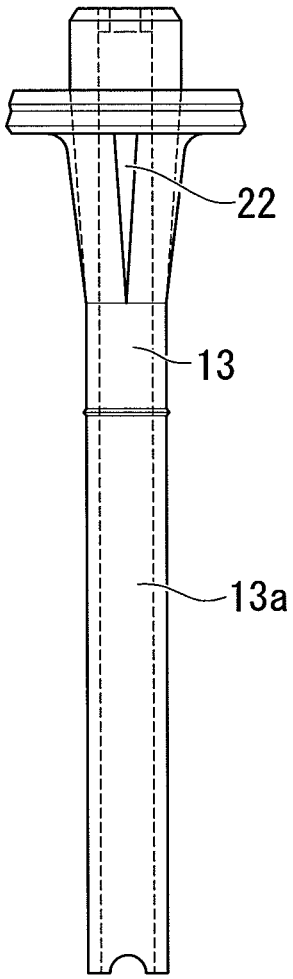
FIG. 8 is a front view that shows the siphon hose and the peripheral structures thereof as a fifth modification of the plug structure according to the present invention.
Figure 9:
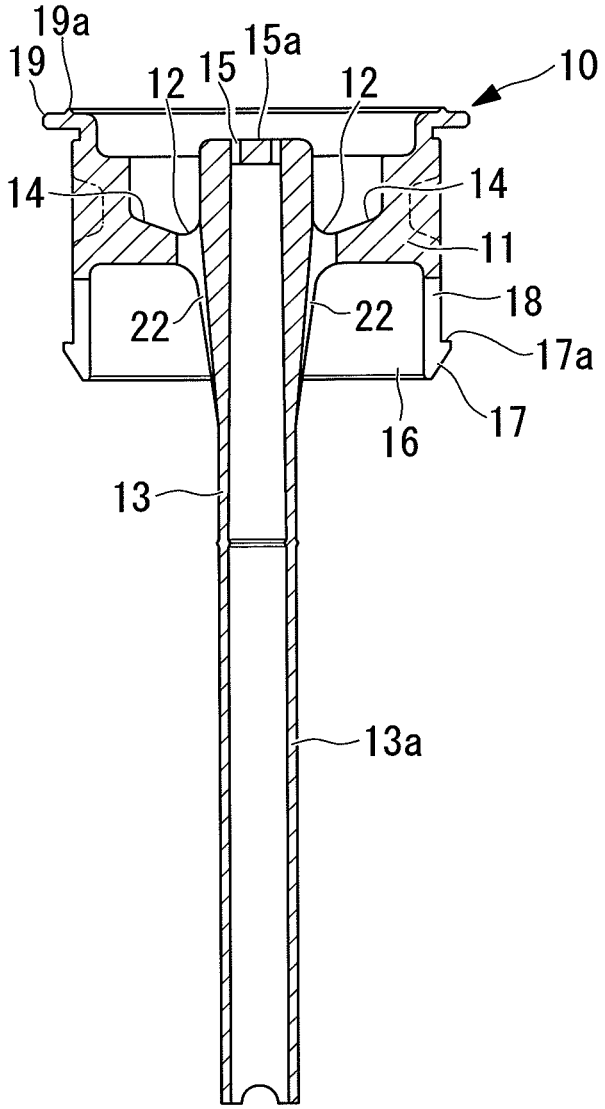
FIG. 9 is a longitudinal cross-sectional view that shows the fifth modification of the plug structure according to the present invention.

In addition, in the fifth modified example that is shown in FIG. 8 and FIG. 9, groove shaped fluid guide portions 22 are provided on the outer wall portion of the siphon hose 13. With respect to the upper portion outer wall of the siphon hose 13, each fluid guide portion 22 is a substantially vertical (i.e., in the axial direction of the siphon hose) groove that is provided so as to continue from the gas supply duct 12 to the outer wall of the siphon hose 13. When such fluid guide portions 22 are provided, the fluid that is returning into the container 1 can be reliably guided to the fluid surface along the outer wall of the siphon hose 13. Note that, preferably, such guide portions 22 are provided in the same number as the number of gas supply ducts 12.

Figure 10A:
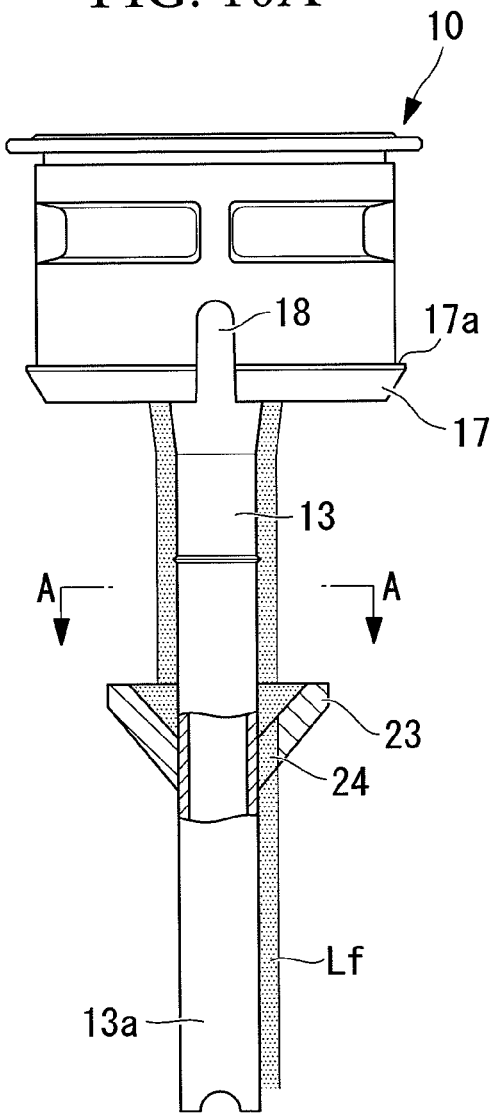
FIG. 10A is a longitudinal cross-sectional view that shows a sixth modification of the plug structure according to the present invention.
Figure 10B:
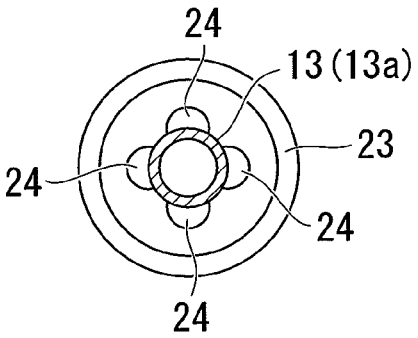
FIG. 10B is a cross-sectional view taken along line A-A in FIG. 10A.

In addition, in the sixth modified example that is shown in FIG. 10A and FIG. 10B, a fluid retaining portion 23 that projects from the outer wall of the siphon hose 13 is provided at a location thereof, and the inner wall of the fluid outlet 24, which passes through and opens in the fluid retaining portion 23, is formed by the surface with the outer wall of the siphon hose 13. Specifically, by providing a fluid retaining portion 23 at a location along the siphon hose 13, because the fluid that is falling along the siphon hose 13 is temporarily retained in the fluid retaining portion 23, it is possible to suppress the falling speed at which the fluid arrives at the fluid surface inside the container 1. At this time, the fluid that is retained in the fluid retaining portion 23 does not fall freely even below the fluid retaining portion 23 because the fluid is discharged downward along the outer wall of the siphon hose from the fluid outlet 24, which has a wall surface that is partially formed by the outer wall of the siphon hose 13.

Note that it is possible to ensure a flow amount that is equal to the fluid circulating amount of the fluid that is flowing into the fluid retaining portion 23, for example, by providing the fluid outlet 24 in this case in plurality.

In this manner, according to the plug structure of the present invention that has been described above, the plug 10, which is used in the container 1 that is filled with a fluid such as a chemical fluid and which is provided with the siphon hose 13 that feeds the fluid to the outside of the container 1, can be installed on the container 1 in which the cap installation thread of the container inlet 2 is an external thread 3. Furthermore, a plug structure is used in which, even during the fluid circulation in which a fluid such as a chemical fluid is circulated, because the fluid circulation path 20 is formed in which the fluid passes from the fluid return path 34 through the gas supply ducts 12 to fall gently on the fluid surface along the outer wall of the siphon hose 13, bubbles do no occur in the fluid surface inside the container 1.

Note that the present invention is not limited by the embodiments that have been described above, and the present 25 invention can be appropriately modified within a range that does not depart from the gist of the invention. An example of such a modification is the presence or absence of the engaging catches.

The invention claimed is:

1. A plug structure that is adapted to be installed in an inlet of a container, the inlet having an external thread, and that is capable of removing a fluid inside the container by using a siphon hose technique, the plug structure comprising:

a plug having a plug body and a siphon hose configured to remove a fluid inside the container, and a socket, wherein the socket comprises:

a socket body, a sleeve that is rotatable around an outer peripheral portion of the socket body, and that has an inner thread that threads onto the external thread of the inlet of the container, a gas path, and a fluid removal path which is formed parallel to the gas path;

a fluid return path which is formed parallel to the gas path;

wherein the plug further comprises a plurality of gas supply ducts for supplying gas which is guided from the gas path into the container, the plurality of gas supply ducts being provided in the plug body; and a fluid retaining portion that projects from an outer wall of the siphon hose and that includes a sloping surface that slopes downward in a direction from an outer periphery toward an inner periphery, the fluid retaining portion being provided at a location between a distal end of the siphon hose and a proximal end of the siphon hose, the fluid retaining portion being separate from the lower end of the plug body, wherein the plurality of the gas supply ducts are disposed at the periphery of an outer wall of the siphon hose, wherein at least one of the plurality of the gas supply ducts is used as a fluid circulation path when the fluid which is inside the container is circulated by returning fluid which has been pushed out from the siphon hose due to gas pressure that has been introduced from the gas path into the container, wherein, when the fluid return path is used for fluid circulation, one end of the fluid return path is communicated with the fluid circulation path which is at least one of the plurality of the gas supply ducts, and the fluid passes through only a closed space, wherein an inner peripheral side wall surface of the gas supply duct is formed by the outer wall of the siphon hose, wherein an inlet of the gas supply duct includes a sloping surface that slopes downward in a direction from an outer periphery toward an inner periphery of the plug body, wherein an inner wall of a fluid outlet which penetrates the inclined surface of the fluid retaining portion is formed by an outer wall of the siphon hose, wherein the fluid retaining portion retains the fluid which is falling from the gas path which is used as the fluid circulation path along the outer wall of the siphon hose and discharges the retained fluid from the fluid outlet downward along the outer wall of the siphon hose, and wherein the fluid retaining portion being provided at approximately a same distance from each of the distal end of the siphon hose and the proximal end of the siphon hose.

2. A plug structure that is adapted to be installed in an inlet of a container, the inlet having an external thread, and that is capable of removing a fluid inside the container by using a siphon hose technique, the plug structure comprising:

a plug having a plug body and a siphon hose configured to remove a fluid inside the container, and a socket, wherein the socket comprises:

a socket body, a sleeve that is rotatable around an outer peripheral portion of the socket body, and that has an inner thread that threads onto the external thread of the inlet of the container, a gas path, and a fluid removal path which is formed parallel to the gas path;

a fluid return path which is formed parallel to the gas path; and wherein the plug further comprises a plurality of gas supply ducts for supplying gas which is guided from the gas path into the container, the plurality of gas supply ducts being provided in the plug body, wherein the plurality of the gas supply ducts are disposed at the periphery of an outer wall of the siphon hose, wherein at least one of the plurality of the gas supply ducts is used as a fluid circulation path when the fluid which is inside the container is circulated by returning fluid which has been pushed out from the siphon hose due to gas pressure that has been introduced from the gas path into the container, wherein, when the fluid return path is used for fluid circulation, one end of the fluid return path is communicated with the fluid circulation path which is at least one of the plurality of the gas supply ducts, and the fluid passes through only a closed space, wherein an inner peripheral side wall surface of the gas supply duct is formed by the outer wall of the siphon hose, wherein an inlet of the gas supply duct includes a sloping surface that slopes downward in a direction from an outer periphery toward an inner periphery of the plug body, wherein a fluid guide portion is provided on an outer wall of the siphon hose, and wherein the fluid guide portion provides a spiral convex portion that continues from the gas supply ducts into the fluid.

* * * * *